US005388291A

United States Patent [19]

Roux

[11] Patent Number: 5,388,291

[45] Date of Patent: Feb. 14, 1995

[54] FLUIDIZED MEDICAL BED EQUIPPED WITH A DEVICE FOR ELIMINATING ITS SOILED GRANULAR CONSTITUENTS

[76] Inventor: Georges Roux, Mas de la Sauvagine, 30220 Aigues-Mortes, France

[21] Appl. No.: 75,526

[22] PCT Filed: Oct. 9, 1992

[86] PCT No.: PCT/FR92/00953

§ 371 Date: Jun. 11, 1993

§ 102(e) Date: Jun. 11, 1993

[87] PCT Pub. No.: WO93/06808

PCT Pub. Date: Apr. 15, 1993

[30] Foreign Application Priority Data

Oct. 11, 1991 [FR] France ..... 91 12851

[51] Int. Cl.[6] ..... A61G 7/00

[52] U.S. Cl. ..... 5/450; 5/453; 5/912

[58] Field of Search ..... 5/606, 450, 453, 912

[56] References Cited

U.S. PATENT DOCUMENTS 1,372,505 3/1921 Hanson .
1,516,528 1/1968 Hargest .
4,483,029 11/1984 Paul ..... 5/453
4,686,723 8/1987 Smith .
4,760,250 9/1988 Kato ..... 5/912 X
4,776,050 10/1988 Goodwin ..... 5/912 X
4,794,659 1/1989 Kurita et al. .
4,835,802 6/1989 Purcey et al. ..... 5/912 X
5,008,965 4/1991 Vrtalik ..... 5/912 X

FOREIGN PATENT DOCUMENTS 2682291 4/1993 France ..... 5/912

*Primary Examiner*—Michael F. Trettel
*Attorney, Agent, or Firm*—Nawrocki, Rooney & Sivertson

[57] ABSTRACT

The invention relates to a fluidized medical bed.

According to the invention, the receptacle (3) of this bed comprises: a lower wall (4); a porous bottom (5) disposed close to the lower wall, covered by a layer of granular constituents (22) and formed in several parts, the upper surfaces of which are inclined towards a waste collector (6, 7) which comprises a reservoir placed below the porous bottom, connected to the lower part of one of said parts (5) of the porous bottom, and comprising a first part (6) fast with the porous bottom, terminated by a shut-off valve (10) provided with a first leakproof coupling (8), and the second part (7) detachably fixed to said coupling (8).

The invention finds an application in the production of a medical bed which is inexpensive to use.

4 Claims, 1 Drawing Sheet

FLUIDIZED MEDICAL BED EQUIPPED WITH A DEVICE FOR ELIMINATING ITS SOILED GRANULAR CONSTITUENTS

BACKGROUND OF THE INVENTION

In a fluidized medical bed containing granular constituents of very small dimensions (of the order of 80 to 150 microns, for example), waste from medical treatment and impurities accumulate and must be evacuated. Instead of emptying all of said partially soiled granular constituents and replacing them with a volume of fresh granular constituents, which is expensive, the invention proposes replacing only those constituents which contain waste or which are soiled.

SUMMARY OF THE INVENTION

To that end, according to the invention, the receptacle that the fluidized medical bed comprises, itself comprises a lower wall; a porous bottom disposed in the vicinity of the lower wall, defining between itself and said wall an enclosure for admission of pressurized gas, covered with a layer of granular constituents and constituted by several parts, of which the upper faces are inclined with respect to the horizontal, each of them having its lower part terminating at a waste collector; at least one waste collector comprising a reservoir, which is placed below the porous bottom, which is connected, in its upper part, to the lower part of at least one of said parts constituting said porous bottom, and which comprises two parts, a first part, fast with the porous bottom, terminating in a shut-off valve provided with a first leakproof coupling and the second part, capable of being detachably fixed to said leakproof coupling of the first part.

The following advantageous arrangements are in addition preferably adopted:

- the second part of the reservoir is provided, in its lower part, with a second coupling for connection of a pressurized gas supply;
- a pressurized gas supply conduit connects said second coupling to said enclosure and comprises two sections connected together by a removable coupling;
- the second part of the reservoir is provided, in its lower part, with an orifice capable of being obturated, usable in particular for extracting the waste.

The principal advantage of a fluidized medical bed according to the invention resides in the possibility of periodically evacuating therefrom the waste and impurities, easily and at low cost.

The invention will be more readily understood and secondary characteristics and their advantages will appear in the course of the description of an embodiment given hereinafter by way of example.

BRIEF DESCRIPTION OF THE DRAWINGS

It is understood that the description and the drawings are given only by way of indicative and non-limiting example.

Reference will be made to the accompanying drawings, in which.

DETAILED DESCRIPTION OF THE INVENTION

Figure 1:
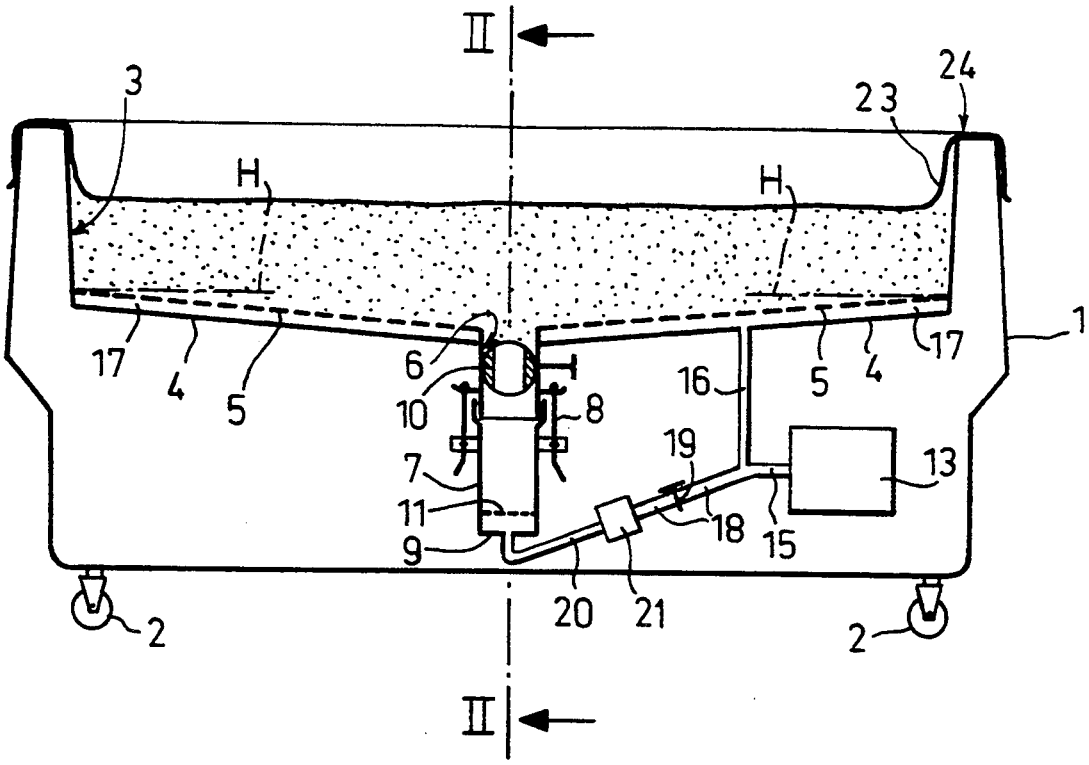
FIG. 1 is a longitudinal section of a fluidized medical bed according to the invention.
Figure 2:
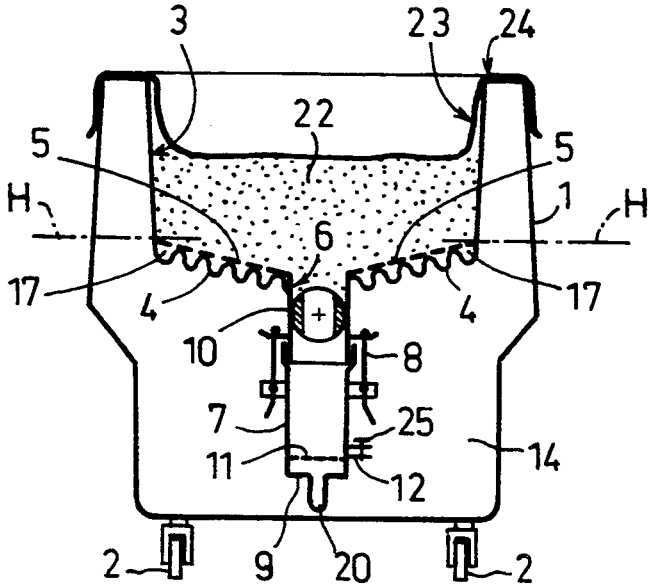
FIG. 2 is a transverse section along II—II of FIG. 1.

The bed shown in the Figures comprises:

- a frame 1, resting on the floor via castors 2;

- a receptacle 3, which constitutes the upper part of the frame 1, is defined by an upper opening and comprises a lower wall 4 made of corrugated sheet metal for example, on which rest gas-porous plates 5 which are all inclined with respect to the horizontal H, descending towards the central part of the receptacle to arrive at the upper part 6 of a vertical cylindrical collector connected to the lower wall 4 and to the plates 5;
- a lower collector part 7 disposed below and following the upper collector part 6, being connected thereto by a rapid coupling 8 and provided with a bottom 9;
- a valve 10, interposed in the upper collector part 6, between its leakproof connection to the plates 5 and to the lower wall 4, and the dismountable rapid coupling 8 and capable of obturating said upper part 6 of the collector;
- a gas-porous wall 11, disposed transversely in the lower collector part 7, above the bottom;
- a suction coupling 12, connected to the lower collector part, above the porous wall 11, provided with a valve 25;
- a device 13, comprising in particular a compressor and an assembly for treating the air, adapted to disinfect and reheat it, if this is necessary, contained in the space 14 inside the frame 1, located below the receptacle 3;
- a delivery conduit 15 of the device 13 to which are connected a first conduit 16 for injection of treated gas in the enclosure 17 included between the lower wall 4 and the porous plates 5, connected to the lower wall 4, and a second conduit 18 for injection of treated gas in the collector 6–7;
- a valve 19, placed in the second conduit 18;
- a conduit 20 connected, on the one hand, to the bottom 9 of the lower part 7 of the collector, on the other hand, by means of a dismountable rapid coupling 21, to the end of the second conduit 18;
- a volume of granular constituents 22, such as microballs with a diameter of 80 to 150 microns, which fills a part of the receptacle 3; and
- a sheet 23, which covers the upper face of the volume of granular constituents 22, abuts on the periphery 24 of the opening of the receptacle 3, and allows a patient to rest in the bed.

It is also indicated that, taking into account the difference in height of the connections of the first conduit 16 to the lower wall 4 of the receptacle and of conduit 20 to the bottom 9 of the lower part 7 of the collector, the compressed gas should be injected at a higher pressure in conduit 20 than in the first conduit 16. This is easily effected, for example by choosing the diameter of the first conduit 16 smaller than that of conduit 20 or by placing on conduit 16 a calibrated restriction, each of these solutions producing on the first conduit 16 a pressure drop allowing the desired difference of the pressures in conduits 16 and 20 to be obtained.

The mode of using the bed is set forth hereinafter:

During the sojourn of a patient in this bed, waste or impurities resulting from the patient's treatment and sojourn pass through the sheet 23 and accumulate towards the bottom of the receptacle 3.

The obliqueness of the plates 5 with respect to the horizontal H and the convergence of these plates towards the upper opening of the upper part 6 of the collector, causes such waste and impurities to accumulate in the collector 6–7. During this first period of use of the bed, valve 10 is open, valve 25 is closed and valve 19 is open, with the result that the treated gas which already fluidizes the granular constituents 22 contained in the receptacle 3, also fluidizes the contents of the collector 6–7, which allows the waste and impurities to descend into the lower part 7 of the collector.

At regular intervals, valves 10 and 19 are closed, which isolates the lower part 7 of the collector from the rest of the bed. (Rapid) dismantling of the couplings 8 and 21 makes it possible to separate this lower part 7 of the collector from the rest of the installation and to empty it of the waste, impurities and soiled granular constituents that it contains. Re-assembly thereof and the re-opening of valves 10 and 19 return the bed into its first configuration of use. It may be observed that this cleaning operation may be carried out whilst the patient is in bed, without having to disturb the patient.

It is also possible to connect an extractor on the coupling 12 and, after having opened valve 25, to suck the waste and impurities from the collector 6–7.

The invention is not limited to the embodiment, but covers, on the contrary, all the variants which may be made thereto without departing from its scope nor its spirit.

I claim:

1. Fluidized medical bed having a receptacle defined by:

a lower wall; and a porous bottom, disposed in the vicinity of, and above, the lower wall, defining between itself and said lower wall an enclosure for admission of pressurized gas, the porous bottom able to be covered with a layer of granular constituents, and the porous bottom defined by several plates having upper faces;

the invention characterized in that the upper faces of said plates of the porous bottom are inclined with respect to the horizontal, each plate having an upper end and a lower end, the lower end terminating at a waste collector, the waste collector comprising a reservoir disposed below the porous bottom, and being connected, at its upper extremity, to the lower end of at least one of said plates defining said porous bottom, said reservoir including two portions, a first portion, secured to the porous bottom and terminating in a shut-off valve provided with a first leakproof coupling, and the second portion capable of being detachably fixed to said leakproof coupling of the first portion.

2. Medical bed according to claim 1, characterized in that:

the second portion of the reservoir is provided, at its lower extremity, with a second coupling for connection of a pressurized gas supply.

3. Medical bed according to claim 2, characterized in that:

a pressurized gas supply conduit connects said second coupling to said enclosure and comprises two sections connected together by a removable coupling.

4. Medical bed according to claim 1, characterized in that:

the second portion of the reservoir is provided, at its lower extremity, with an orifice capable of being obturated and usable in particular for extracting the waste.

* * * * *